US006156185A

United States Patent [19]

Chen et al.

[11] Patent Number: 6,156,185

[45] Date of Patent: Dec. 5, 2000

[54] REACTIVATION OF DEACTIVATED ANODES

[75] Inventors: Chao-Peng Chen; Tilak V. Bommaraju, both of Grand Island, N.Y.

[73] Assignee: Occidental Chemical Corporation, Dallas, Tex.

[21] Appl. No.: 09/330,616

[22] Filed: Jun. 11, 1999

Related U.S. Application Data

[62] Division of application No. 08/432,474, May 1, 1995, Pat. No. 5,948,222.

[51] Int. Cl.[7] ..... C25B 1/34

[52] U.S. Cl. ..... 205/532; 427/443.1; 427/437; 427/125; 427/126.5; 204/290.14

[58] Field of Search ..... 427/443.1, 437, 427/125, 126.5, 98; 204/290.14, 290.01; 205/532

[56] References Cited

U.S. PATENT DOCUMENTS

| | | | |
|---|---|---|---|
| 3,684,543 | 8/1972 | de Nora et al. | 117/2 R |
| 5,298,280 | 3/1994 | Kaczur et al. | 427/125 |

*Primary Examiner*—Kathryn Gorgos
*Assistant Examiner*—Michael J Feely
*Attorney, Agent, or Firm*—Richard D. Fuerle; Anne E. Brookes

[57] ABSTRACT

Disclosed is a method of reactivating a deactivated anode that has a coating of a noble metal or noble metal oxide on a substrate. A coating of a noble metal is deposited on the anode electrolessly. The noble metal in the deposited coating can be platinum, palladium, iridium, rhodium, ruthenium, osmium, or a mixture thereof.

11 Claims, 4 Drawing Sheets

REACTIVATION OF DEACTIVATED ANODES

This application is a division of application Ser. No. 08/432,474 filed May 1, 1995, now U.S. Pat. No. 5,948,222.

BACKGROUND OF THE INVENTION

This invention relates to the reactivation of noble metal or noble metal oxide coated anodes that have been deactivated. In particular, it relates to coating deactivated anodes with a noble metal such as platinum to reactivate them.

Anodes are used in the electrolytic production of caustic soda, chlorine, sodium chlorate, and other products. A typical industrial anode consists of a titanium substrate that is coated with a mixture of noble metals or a mixture of a noble metal oxide and a valve metal oxide. After a period of use, the anodes become deactivated or passivated, and more and more voltage is required to obtain the same output of product. When the anode potential exceeds 1.4 volts versus SCE (saturated calomel electrode) in a saturated brine solution, the anode is considered to be deactivated to the extent that it is more economical to replace or recoat it than to continue using it.

At the present time, deactivated anodes are refurbished by sandblasting the noble metal or metal oxide coating off the substrate, etching the substrate with hydrochloric acid or oxalic acid to remove surface oxides of titanium, and applying a fresh coating to the substrate. To apply a coating of, for example, $RuO_2/TiO_2$, the substrate is painted with a mixture of ruthenium trichloride and butyltitanate in water or isopropanol until a coating forms. The coating is then heated to form the oxides. This procedure is repeated as many times as is necessary to obtain a coating about 10 to about 15 microns thick or a noble metal loading of about 3 to about 15 $g/m^2$. Considerable expense is involved in producing a reactivated anode by this procedure.

SUMMARY OF THE INVENTION

We have discovered that deactivated anodes can be reactivated without removing and replacing the existing coating on the anode. In the method of this invention, a coating of a noble metal is deposited over the existing coating on the deactivated anode. This deposition can occur either electrolessly or electrolytically. Either method of deposition is relatively simple and can be accomplished without the expenditure of much labor or material. Reactivation can even be accomplished in situ, without removing the anode from its cell.

Surprisingly, we have discovered that in a standard test for anode life, an anode reactivated according to the method of this invention lasts longer than an anode reactivated by stripping and replacing the coating on the anode. Thus, not only is the method of this invention simpler and less expensive, but it also results in a better quality anode. Because the reactivation method of this invention is less expensive than the prior reactivation method, it is expected that it will be economical to reactivate anodes at an earlier stage, thereby saving electricity.

DESCRIPTION OF THE PREFERRED EMBODIMENTS

Figure 1:
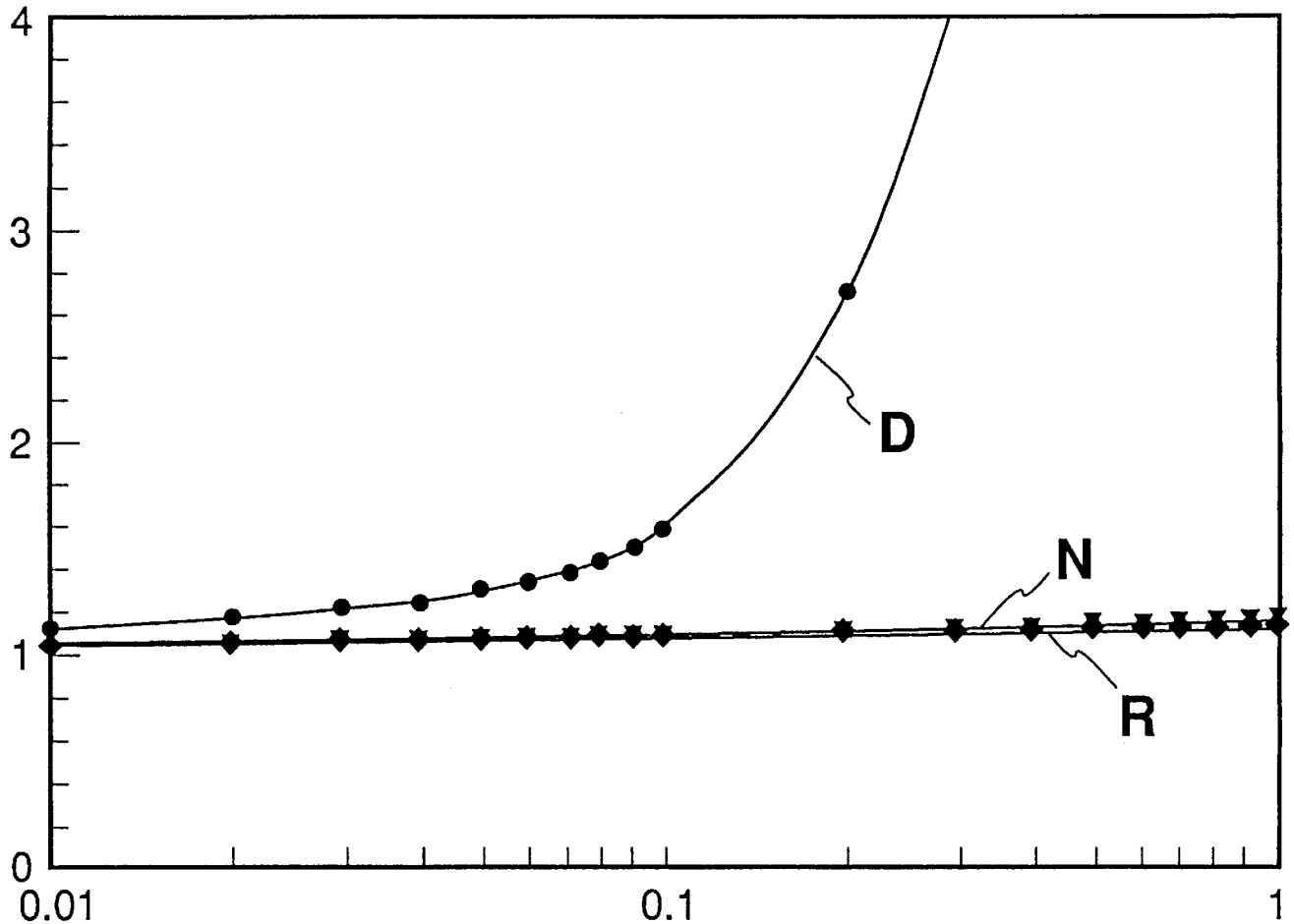
FIGS. 1 to 4 are graphs giving the results of Examples 1 to 4, respectively, where the current density versus electrode potential of anodes reactivated according to this invention is compared to the anodes when they were new and deactivated. The ordinate is potential vs. SCE in volts and the abscissa is current density in amperes per square centimeter.

This invention applies to deactivated anodes that consist of a substrate having a coating thereon of a noble metal or noble metal oxide. Most industrial anodes use a titanium substrate because it is most compatible with the coating, but other substrate materials can also be used, and they do not affect the process of this invention. The most common coating for anodes contains ruthenium oxide and titanium oxide in a ratio of about 10 to about 50 mol % ruthenium oxide and about 50 to about 90 mol % titanium oxide. This coating typically has about 3 to about 15 grams of ruthenium per square meter and is about 10 to about 15 microns thick. Other coatings that are used include mixtures of platinum and iridium metals. Other noble metals or noble metal oxides are also effective.

In the method of this invention, the deactivated anode is treated in its existing condition without removal of its present coating. However, for better adhesion it is preferable to clean the anode before reactivating it. Cleaning can be accomplished, for example, by soaking the anode in a 5 wt % solution of NaOH or at 10 wt % solution of HCl for about 30 minutes.

A coating of a noble metal is applied electrolessly or electrolytically over the coating already on the anode. The noble metals that can be used are platinum, palladium, iridium, rhodium, ruthenium, osmium, and mixtures thereof. Platinum is preferred because it is readily available and can be deposited electrolessly which results in a more uniform deposit.

Electroless coating of noble metals onto substrates is a process well-known in the literature. See, for example, the article, "Electroless Platinum Plating," by Kenji Takahashi in *Hyomen Gijutsu*, Vol. 42, No. 11, (1991), pages 1100–1103, and the article "Deposition of Platinum By Chemical Reduction of Aqueous Solutions," by F. H. Leaman in *Plating*, (May 1972), pages 440–444, herein incorporated by reference. The electroless plating in the method of this invention can proceed according to such known methods. Briefly, an aqueous solution is prepared of a water-soluble compound of the noble metal to be plated. Stabilizers, reducing agents, and other chemicals may be added to the solution and the pH may be adjusted, as is known in the art. The deactivated anode, in its existing condition, is placed in the electroless coating solution for a time sufficient to form a coating of the noble metal on the anode of about 1 to about 15 grams per square meter. If less noble metal is deposited, the life of the anode may be shorter, and if more noble metal is deposited, it may not adhere well to the anode. Preferably, about 3 to about 5 grams per square meter of the noble metal is deposited. Normally, this will require only a few hours. After a deposit of the noble metal has been formed of the required thickness, the reactivated anode is simply removed from the coating solution, washed with water, and is ready for use. It is not heated, and there is normally no need to dry it.

Alternatively, the coating of the noble metal on the anode can be formed electrolytically, also using procedures well-known in the art. See, for example, "Metal Finishing Guidebook and Directory Issue '91, " published by Metals and Plastics Publications, Inc., page 258, herein incorporated by reference. Briefly, an aqueous solution is prepared of a water-soluble noble metal compound. An electrolyte is added to the solution as necessary, and a direct current is applied with the anode negative for a time sufficient to deposit a coating of the noble metal thereon as described hereinabove for electroless coating. At the present time, electroless coating is preferred, as it is simpler and coatings formed electrolessly have a longer life in a standardized test for anode life.

Coating of the anode can be performed in situ, without first removing the anode from its cell. The cell is drained, washed, and filled with the electroless or electrolytic coating solution. After the anode has been coated, the cell is again drained and washed. It is refilled and is ready for use.

The following examples further illustrate this invention.

EXAMPLE 1

An $RuO_2/TiO_2$ anode (analyzing 60:40 mol % of Ru:Ti) was prepared following the method described in U.S. Pat. No. 3,632,498, herein incorporated by reference. The anode was subjected to electrolysis in 0.5M $H_2SO_4$ at a current density of 0.5 A/cm$^2$. After 52 hours, the anode potential jumped up to 8 volts.

This electrode was electrolessly plated with Pt at 25° C. from a solution consisting of 10 g/l $Na_2Pt(OH)_6$, 5 g/l NaOH, 20 g/l ethylamine stabilizer, and 1 g/l hydrazine reducing agent. After one hour of plating, the anode was tested and it was found that its activity had been fully restored. The current density (A/cm$^2$) versus anode potential versus SCE (V) of the new anode (N), the deactivated anode (D), and the anode after reactivation (R) according to the method of this invention were measured using 300 g/l NaCl at a pH of 4 and 70° C. (The same testing procedure was also used in Examples 2, 3, and 4.) FIG. 1 shows that the reactivated anode performed almost identically as well as the new anode.

EXAMPLE 2

Figure 2:
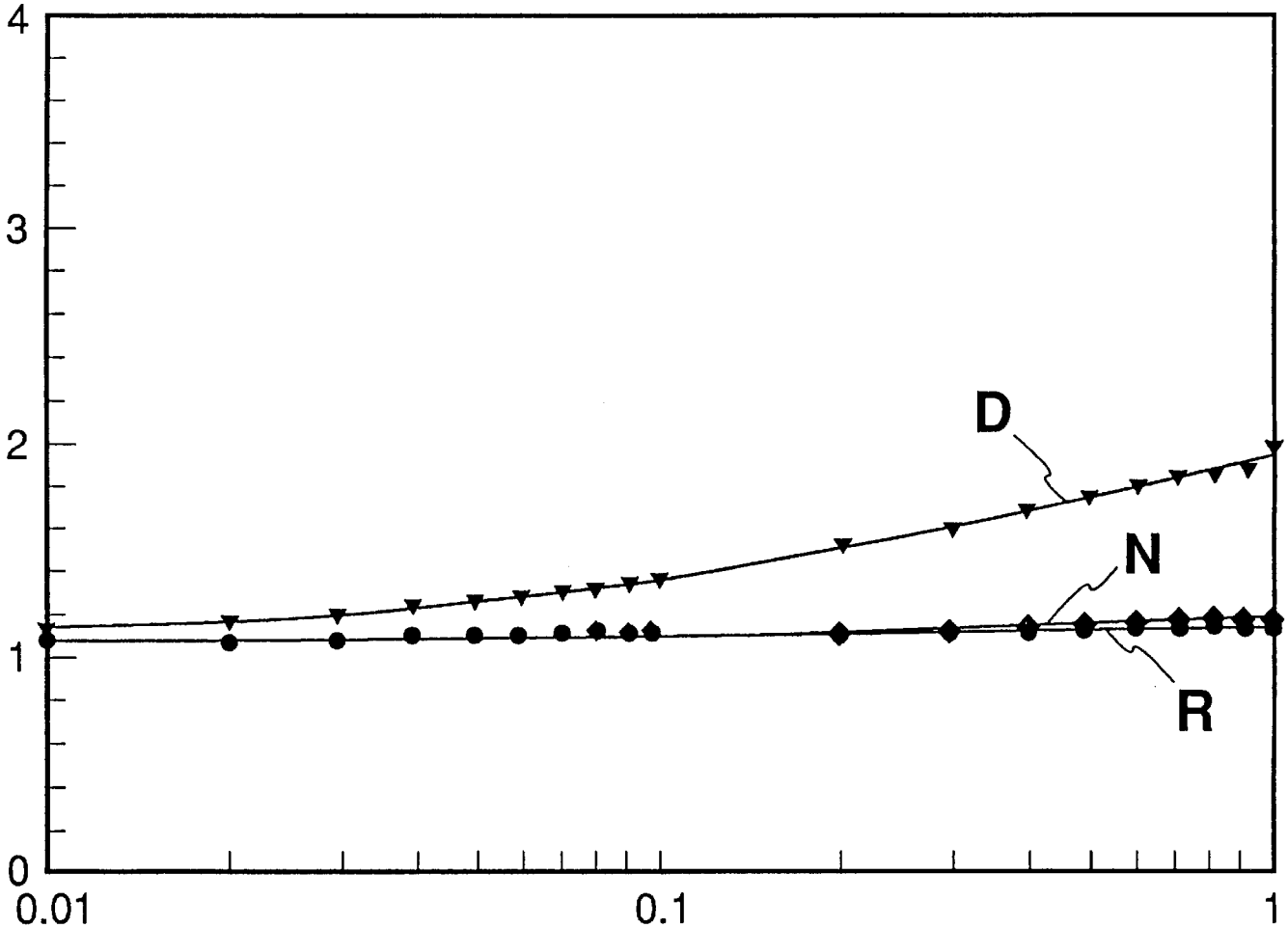

A failed $RuO_2/TiO_2$ anode from a chlor-alkali membrane cell plant, which exhibited an anode potential of 1.6 volts vs. SCE at 0.4 A/cm$^2$ in saturated brine solutions at 70° C., was electrolessly coated with Pt as described in Example 1. After four hours of plating, the activity of this anode was completely restored, as shown in FIG. 2.

EXAMPLE 3

Figure 3:
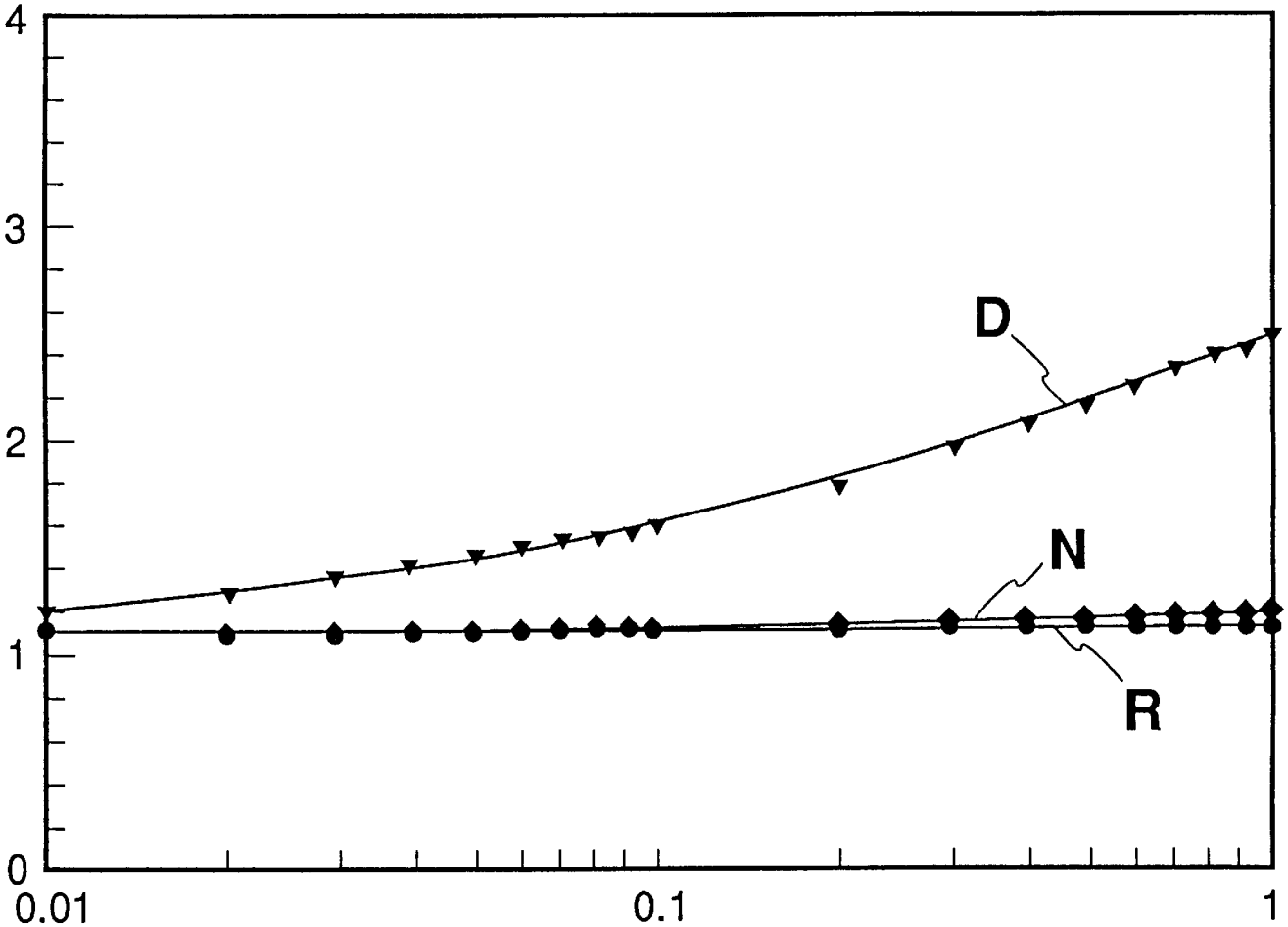

An inactive $RuO_2/TiO_2$ anode from a chlor-alkali diaphragm cell plant, which exhibited an anode potential of 2.2 volts vs. SCE at 0.4 A/cm$^2$ in saturated brine solutions at 70° C., was plated with Pt by the electroless method described in Example 1. After a four hour plating, the activity of this anode was completely restored, as shown in FIG. 3.

EXAMPLE 4

Figure 4:
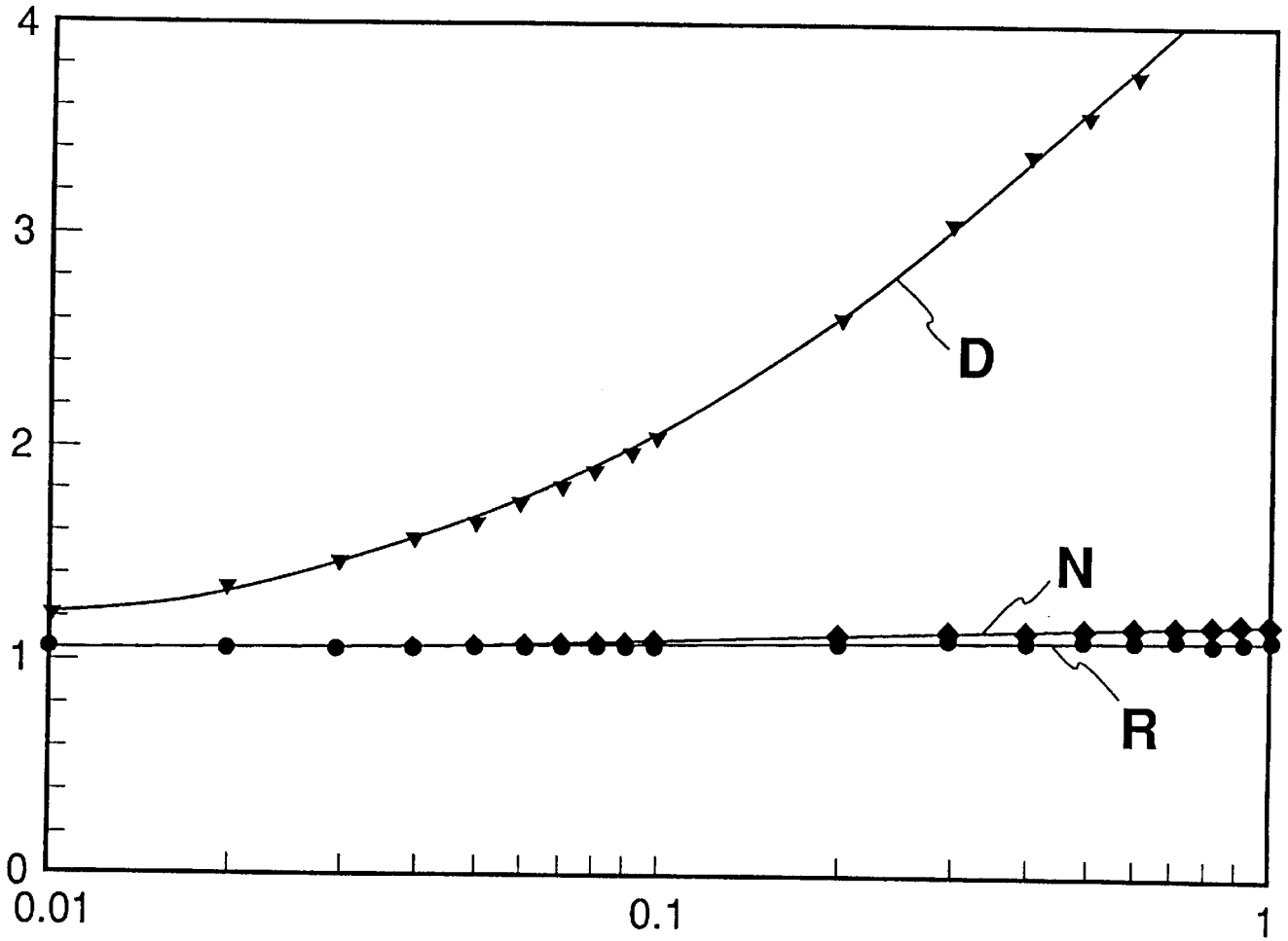

Two failed $RuO_2/TiO_2$ anodes from a chlorate plant, each exhibiting an anode potential of 3.4 volts vs. SCE at 0.4 A/cm$^2$ in saturated brine solutions at 70° C., were plated, one with Pt by the electroless method described in Example 1 and the other with Pt by the electrolytic method at a current density of 0.034 A/cm$^2$ at 25° C. using a solution of 0.68 g/l chloroplatinic acid ($H_2Cl_6Pt$) in 1M NaOH as the electrolyte. After four hours of plating, the activities of the two anodes were identical, but the electroless method produced a more uniform coating on the anode surface. FIG. 4 shows that the activities of both anodes were completely restored.

EXAMPLE 5

In a standardized test for anode life, new anodes, which consisted of a titanium substrate having a coating of $RuO_2/TiO_2$, were placed in one normal sulfuric acid at 0.5 amps/cm$^2$. After about 55 to 60 hours,its anode potential exceeded 1.4 volts and they were, therefore, considered to be deactivated. The deactivated anodes were reactivated as described in Examples 1 and 4, and were retested under the same conditions. The electrolessly coated anode prepared as described in Example 1 was not deactivated after more than 60 hours (when the test was terminated), and the electrolytically reactivated anode, prepared as in Example 4, was deactivated after about 55 hours.

We claim:

1. A method of reactivating a deactivated anode which comprises a substrate having thereon an anode coating of noble metal or noble metal oxide, comprising electrolessly depositing on said anode coating, without removing said anode from the cell in which it was used, a reactivating coating of a noble metal selected from the group consisting of platinum, palladium, iridium, rhodium, ruthenium, osmium, and mixtures thereof.

2. A method according to claim 1 wherein said anode coating contains about 10 to about 50 mol % $RuO_2$ and about 50 to about 90 mol % $TiO_2$.

3. A method according to claim 1 wherein said anode coating is cleaned prior to depositing said reactivating coating.

4. A method according to claim 1 wherein said anode coating is a mixture of platinum and iridium.

5. A method according to claim 1 wherein said reactivating coating is platinum.

6. A reactivated anode made according to the method of claim 1.

7. A method of making a reactivated anode from a deactivated anode which comprises a titanium substrate having an $RuO_2TiO_2$ coating thereon, comprising filling the cell in which said deactivated anode was used with an electroless platinum coating solution for a period sufficient to deposit about 1 to about 15 grams/m$^2$ of platinum on said anode.

8. A method according to claim 7 wherein about 3 to about 5 gm/m$^2$ of platinum are electrolessly deposited on said deactivated anode.

9. A method according to claim 7 wherein said electroless platinum coating solution comprises an aqueous solution of $Na_2Pt(OH)_6$.

10. A reactivated anode made according to the method of claim 7.

11. In a method of electrolyzing an aqueous brine solution in a cell containing said solution and an anode, the improvement wherein the anode is a reactivated anode made according to the method of claim 11.

* * * * *